US006435964B1

(12) United States Patent
Chang

(10) Patent No.: US 6,435,964 B1
(45) Date of Patent: Aug. 20, 2002

(54) VENTILATION FAN

(75) Inventor: Hsin Chung Chang, Taoyuan Hsien (TW)

(73) Assignee: Enlight Corporation (TW)

( * ) Notice: Subject to any disclaimer, the term of this patent is extended or adjusted under 35 U.S.C. 154(b) by 0 days.

(21) Appl. No.: 09/946,481

(22) Filed: Sep. 6, 2001

(51) Int. Cl.[7] ..... F24F 7/06
(52) U.S. Cl. ..... 454/349; 454/354; 454/355
(58) Field of Search ..... 454/341, 346, 454/349, 352, 353, 354, 355

(56) References Cited

U.S. PATENT DOCUMENTS 3,305,163 A * 2/1967 Sheppard ..... 415/201

FOREIGN PATENT DOCUMENTS

| | | | | |
|---|---|---|---|---|
| JP | 52-11639 | * | 1/1977 | ..... 454/354 |
| JP | 59-197745 | * | 11/1984 | ..... 454/355 |
| JP | 6-147582 | * | 5/1994 | ..... 454/354 |

* cited by examiner

*Primary Examiner*—Harold Joyce
(74) *Attorney, Agent, or Firm*—Troxell Law Office PLLC

(57) ABSTRACT

A ventilation fan includes a case-like frame having an opening and a rib in the opening, a motor fastened to the rib inside the case-like frame, a face cover detachably covered on the case-like frame, the face cover having air inlets in communication with the opening of the case-like frame, a centrifugal fan fastened to. the motor shaft of the motor and disposed outside the case-like frame, and a wind box detachably covered on the outside of the case-like frame over the centrifugal fan.

1 Claim, 5 Drawing Sheets

VENTILATION FAN

BACKGROUND OF THE INVENTION

The present invention relates a ventilation fan and, more particularly, to a bathroom ventilation fan, which has a compact size and, facilitates the performance of repair and maintenance work.

FIGS. 1 and 2 show a bathroom ventilation fan according to the prior art. This structure of bathroom ventilation fan comprises a housing 1', a fan motor 2', and a centrifugal fan 3'. The housing 1' has a wind box 11', and a rack 12' provided inside the wind box 11'. The fan motor 2' and the centrifugal fan 3' are mounted inside the wind box 11'. During a repair work, the rack 12' must be removed from the housing 1' at first, enabling the fan motor 2' to be exposed to the outside. Because the rack 12' is fastened to the inside of the housing 1' with multiple screws, it takes much time to remove the rack 12' from the housing 1'. Further, because the motor 2' and the centrifugal fan 3' are disposed at the same side inside the wind box 11', the wind box 11' must have sufficient space to hold the motor 2' and the centrifugal fan 3'. Due to this reason, this design of ventilation fan is heavy and bulky.

BRIEF DESCRIPTION OF THE DRAWINGS

The present invention has been accomplished to provide a ventilation fan, which eliminates the aforesaid drawbacks. It is one object of the present invention to provide a ventilation fan, which has a compact structure. It is another object of the present invention to provide a ventilation fan, which facilitates the performance of repair and maintenance work. According to one aspect of the present invention, the ventilation fan comprises a case-like frame having an opening and a rib in the opening, a motor fastened to the rib inside the case-like frame, a face cover detachably covered on the case-like frame, the face cover having air inlets in communication with the opening of the case-like frame, a centrifugal fan fastened to the motor shaft of the motor and disposed outside the case-like frame, and a wind box detachably covered on the outside of the case-like frame over the centrifugal fan. According to another aspect of the present invention, the wind box is fastened to the case-like frame by a hooked joint.

BRIEF DESCRIPTION OF THE DRAWINGS

Figure 1:
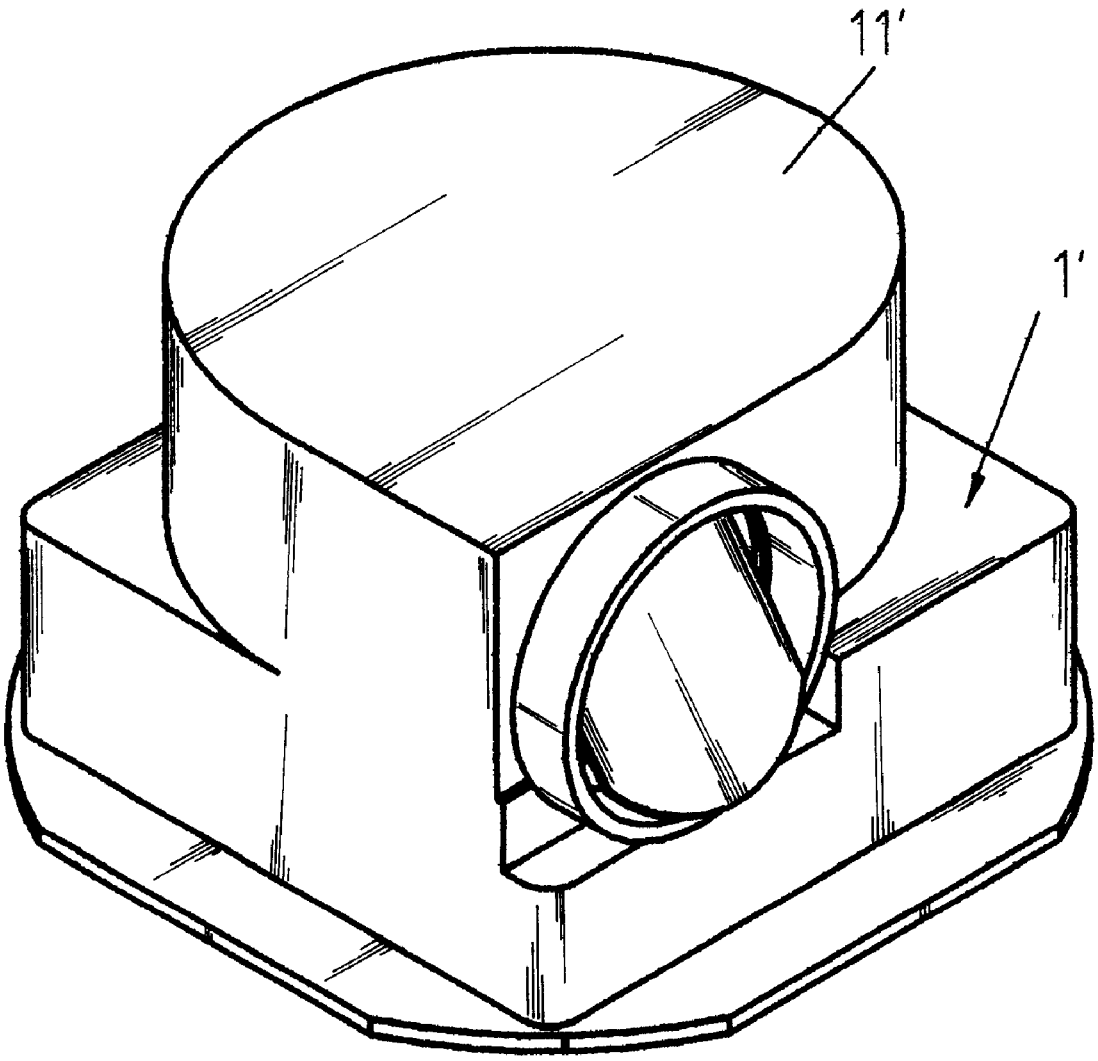
FIG.1 Prior Art

FIG. 1 is an elevational view of a ventilation fan according to the prior art.

Figure 2:
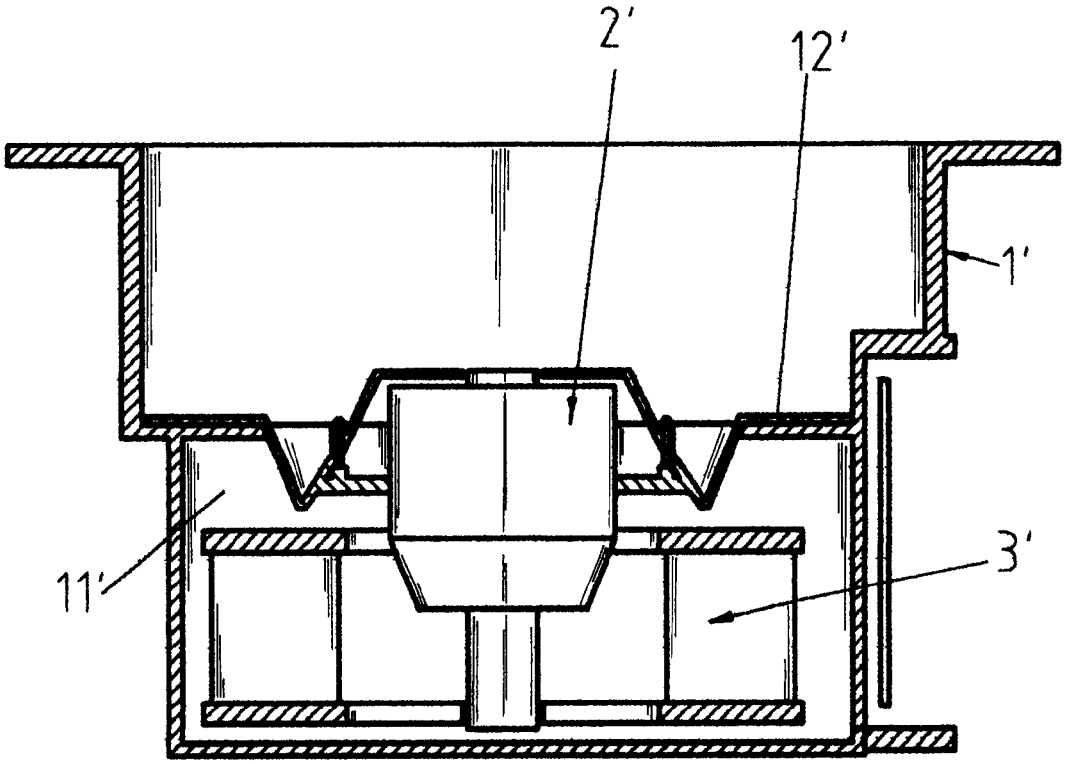
FIG.2 Prior Art

FIG. 2 is a sectional assembly view of the ventilation fan according to the prior art.

Figure 3:
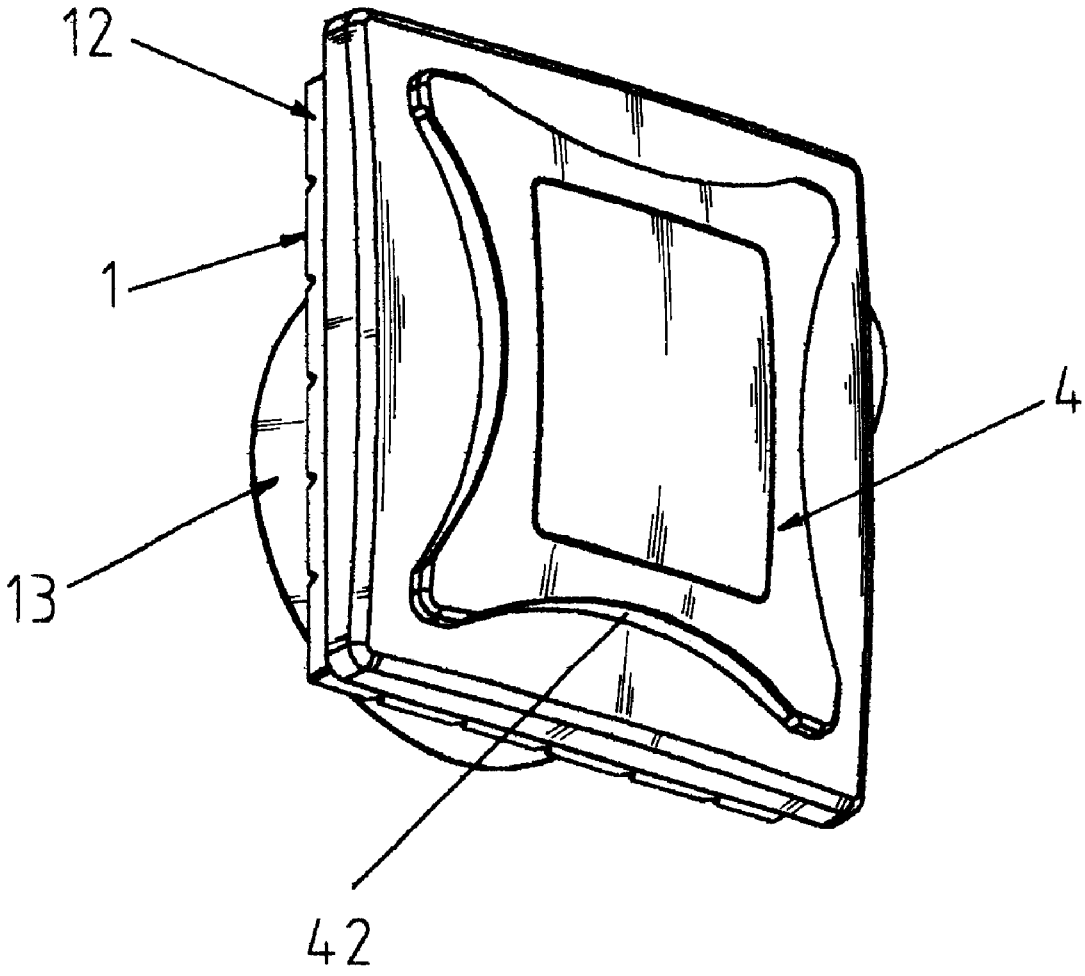

FIG. 3 is an elevational view of a ventilation fan according to the present invention.

Figure 4:
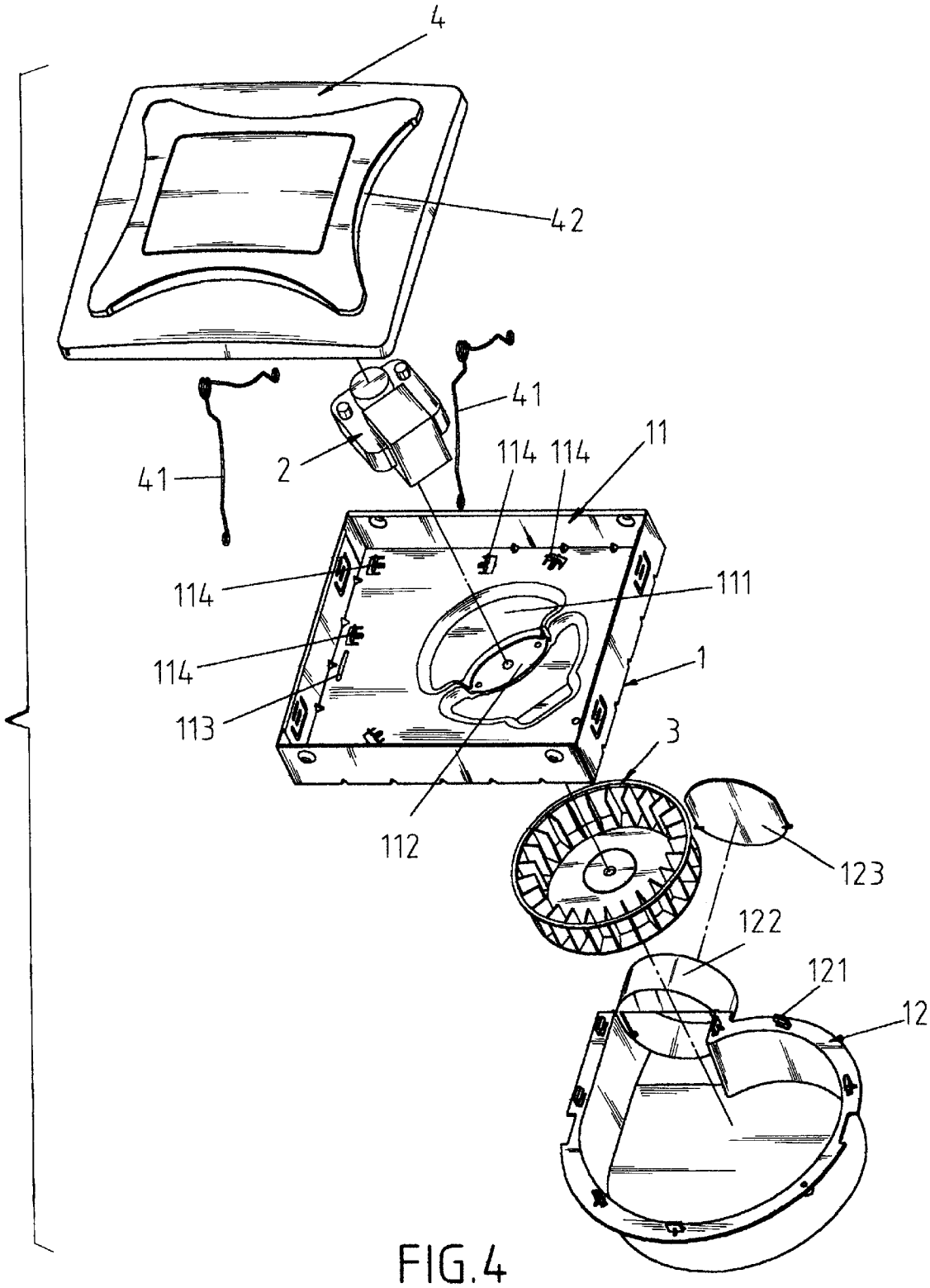

FIG. 4 is an exploded view of the ventilation fan shown in FIG. 3.

Figure 5:
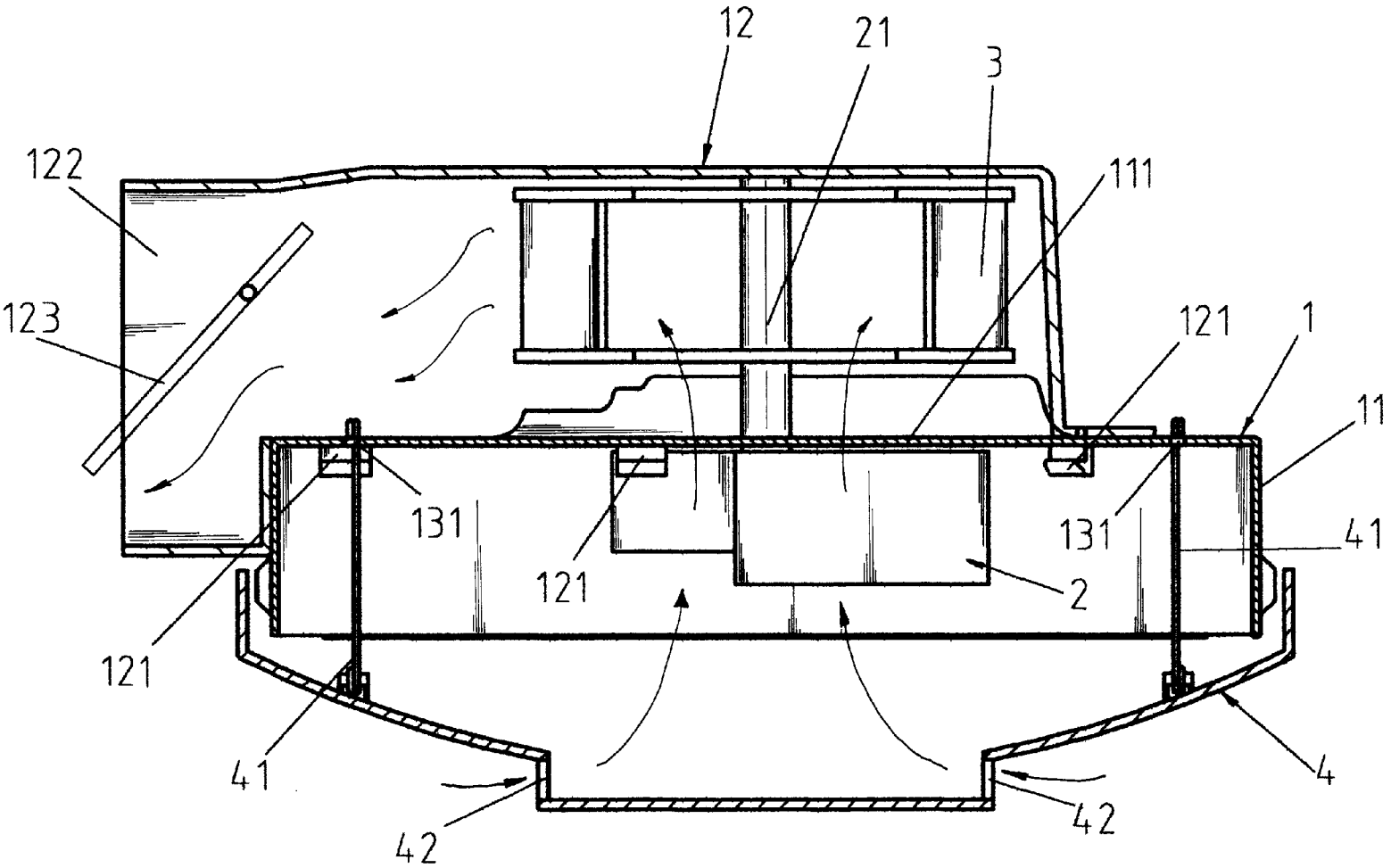

FIG. 5 is a sectional assembly view in an enlarged scale of the ventilation fan shown in FIG. 3.

DETAILED DESCRIPTION OF THE PREFERRED EMBODIMENT

Referring to FIGS. from 3 through 5, a ventilation fan in accordance with the present invention is shown comprised of a housing 1, a motor 2, a centrifugal fan 3, and a face cover 4.

The housing 1 comprises a rectangular case-like frame 11, and a wind box 12. The case-like frame 11 comprises an opening 111, a rib 112 extended across the center of the opening 111, two elongated slots 113 disposed two sides, and a plurality of retaining holes 114. The motor 2 is fixedly fastened to the rib 112 and disposed inside the case-like frame 11, having a motor shaft 21 extended to the outside of the case-like frame 11. The centrifugal fan 3 is fastened to the motor shaft 21 of the motor 2 and disposed outside the case-like frame 11. The face cover 4 is covered on the case-like frame 1, comprising coupling flanges 41 respectively fastened to the elongated slots 113 of the case-like frame 1, and a plurality of air inlets 42.

The wind box 12 is a whirl pool chamber covered on the outside wall of the case-like frame 1 over the centrifugal fan 3, comprising a plurality of border hooks 121 respectively fastened to the retaining holes 114 of the case-like frame 1, an air output port 122 for output of air from the centrifugal fan 3, and a valve flap 123 hinged to the air output port 122. The valve flap 123 enables air to pass out of the wind box 12, and prohibits outside air from passing through the air output port 122 to the inside of the wind box 12.

Referring to FIG. 5 again, when starting the motor 2 to rotate the centrifugal fan 3, foggy air is drawn from the bathroom through the air inlets 42 of the face cover 4 and the opening 111 of the case-like frame 11 into the inside of the wind box 12, and then guided out of the wind box 12 through the air output port 122 by the centrifugal fan 3.

As indicated above, the motor 2 and the centrifugal fan 3 are fastened to two opposite sides of the case-like frame 1. After removal of the face cover 4 from the case-like frame 1, the motor 2 is exposed to the outside, and the user can directly check the motor 2 during a maintenance work. Further, the wind box 12 can also be easily quickly disconnected from the case-like frame 1 when cleaning the centrifugal fan 3. Because the motor 2 is not installed in the wind box 12, the dimension of the wind box 12 can be minimized. Therefore, the ventilation fan of the present invention is compact and, can easily be installed in the bathroom.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A ventilation fan comprising a housing, a motor, a centrifugal fan, and a face cover, wherein said housing is comprised of a rectangular case-like frame and a wind box, said case-like frame comprising an opening through top and bottom sides thereof, a rib extended across the center of said opening and adapted to hold said motor inside said case-like frame in such a position that the motor shaft of the motor extends over the top side of said case-like frame for the mounting of said centrifugal fan; two elongated slots disposed on the top side of said case-like frame, and a plurality of retaining holes, said wind box being a whirl pool chamber covered on the top side of said case-like frame over said centrifugal fan, said wind box comprising a plurality of border hooks respectively fastened to the retaining holes of said case-like frame, an air output port for output of air, and a valve flap hinged to said air output port to let air pass through said air output port to the outside of said wind box and to prohibit outside air from passing through said air output port to the inside of said wind box;

said face cover is covered on said the bottom side of case-like frame over said motor, comprising two coupling flanges respectively fastened to the elongated slots of said case-like frame, and a plurality of air inlets in air communication with said opening of said case-like frame.

* * * * *